US007930917B2

(12) United States Patent
Katagiri et al.

(10) Patent No.: US 7,930,917 B2
(45) **Date of Patent: *Apr. 26, 2011**

(54) LOCK DEVICE

(75) Inventors: Toshiharu Katagiri, Aichi-ken (JP); Takumi Tamezane, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 156 days.

This patent is subject to a terminal disclaimer.

(21) Appl. No.: 12/055,910

(22) Filed: Mar. 26, 2008

(65) Prior Publication Data

US 2008/0236225 A1 Oct. 2, 2008

(30) Foreign Application Priority Data

Mar. 30, 2007 (JP) ..... 2007-092813

(51) Int. Cl.
*E05B 27/00* (2006.01)

(52) U.S. Cl. ..... 70/387; 70/361; 70/379 R; 70/DIG. 20

(58) Field of Classification Search ..... 70/361, 70/377, 379 R, 387, 188, 338, 345, 352, 405, 70/DIG. 20

See application file for complete search history.

(56) References Cited

U.S. PATENT DOCUMENTS

| | | | | |
|---|---|---|---|---|
| 957,938 A | | 5/1910 | Cox | |
| 1,288,074 A | | 12/1918 | Lutz | |
| 1,887,016 A | * | 11/1932 | Hagstrom et al. | 70/361 |
| 2,454,926 A | | 11/1948 | Jacobi | |
| 2,683,978 A | | 7/1954 | Jacobi | |
| 3,455,128 A | * | 7/1969 | Tenkoff | 70/361 |
| 3,659,444 A | * | 5/1972 | Wellekens | 70/360 |
| 4,418,554 A | * | 12/1983 | Wolfgang | 70/360 |
| 4,759,204 A | | 7/1988 | Neyret | |
| 4,903,512 A | | 2/1990 | Leroy et al. | |
| 4,905,487 A | | 3/1990 | Morikawa et al. | |
| 5,138,856 A | * | 8/1992 | Chyun | 70/379 R |
| 5,146,770 A | * | 9/1992 | Yun-Sheng | 70/387 |
| 5,181,407 A | * | 1/1993 | Wu | 70/361 |
| 5,265,453 A | | 11/1993 | Konii et al. | |
| 5,265,455 A | * | 11/1993 | Grimmer | 70/375 |
| 5,295,377 A | * | 3/1994 | Moricz et al. | 70/379 R |
| 5,640,864 A | | 6/1997 | Miyamoto | |

(Continued)

FOREIGN PATENT DOCUMENTS

JP 5-59849 A 3/1993

(Continued)

*Primary Examiner* — Lloyd A Gall
*Assistant Examiner* — Christopher Boswell
(74) *Attorney, Agent, or Firm* — Roberts Mlotkowski Safran & Cole P.C.

(57) ABSTRACT

A lock device includes: a case member that is attached to a lock target; a sleeve member that is housed inside the case member such that the sleeve member is movable along an axial direction; a plunger member that is housed inside the sleeve member such that the plunger member is movable along the axial direction; a coupling structure in which a key insertion hole that allows insertion of a key is formed, the coupling structure being placed inside the plunger member and coupling together the sleeve member and the plunger member; and a manipulable member that is rotatably coupled to the sleeve member and the plunger member, rotates when just the plunger member moves, and releases the locked state of the lock target. The coupling structure is configured to release the coupling just when a regular key is inserted into the key insertion hole.

11 Claims, 9 Drawing Sheets

U.S. PATENT DOCUMENTS

| | | | | |
|---|---|---|---|---|
| 5,722,275 | A | 3/1998 | Price et al. | |
| 5,732,580 | A | 3/1998 | Garnault et al. | |
| 5,765,417 | A | 6/1998 | Bolton | |
| 6,098,434 | A * | 8/2000 | Liou | 70/360 |
| 6,523,382 | B1 | 2/2003 | Dimig et al. | |
| 6,761,052 | B2 * | 7/2004 | Buschmann | 70/361 |
| 6,776,016 | B1 | 8/2004 | Wittwer et al. | |
| 6,978,645 | B2 * | 12/2005 | Shimon | 70/379 R |
| 7,716,960 | B2 * | 5/2010 | Tamezane et al. | 70/361 |
| 2003/0172695 | A1 * | 9/2003 | Buschmann | 70/361 |
| 2007/0214847 | A1 | 9/2007 | Tamezane et al. | |

FOREIGN PATENT DOCUMENTS

| | | | |
|---|---|---|---|
| JP | 8-4387 | A | 1/1996 |
| WO | 02/27124 | A1 | 4/2002 |

* cited by examiner

LOCK DEVICE

CROSS-REFERENCE TO RELATED APPLICATION

This application claims priority under 35 USC 119 from Japanese Patent Application No. 2007-92813, the disclosure of which is incorporated by reference herein.

BACKGROUND OF THE INVENTION

1. Field of the Invention

The present invention relates to a lock device that locks and unlocks a lock mechanism or the like by manipulation of a key inserted into a key insertion hole.

2. Description of the Related Art

A lock device disposed in a door of an automobile or the like is, for example, disposed with a cylindrical case member, a sleeve member that is rotatably disposed inside the case member, a plunger member that is rotatably disposed inside the sleeve member, a rear rotor that is rotatably disposed so as to face the plunger member in an axial direction, and a lock lever that is disposed so as to rotate integrally with the rear rotor (e.g., see Japanese Patent Application Publication (JP-A) No. 8-4387).

This lock device is configured such that, when a regular key is inserted into a key hole, the plunger member releases the state of engagement between the plunger member and the sleeve member, just the plunger member becomes rotatable, and the plunger member can cause the rear rotor to rotate. Thus, the lock lever rotates together with the rear rotor, and a lock mechanism in a door of a vehicle or the like is unlocked by the manipulating force of the lock lever.

Further, when a key substitute, such as a key whose shape is different from that of the regular key or a driver (these will generically be called an "irregular key" below), is inserted into the key hole in the plunger member and forcibly rotated, tumbler members maintain the state of engagement between the plunger member and the sleeve member, and the plunger member and the sleeve member integrally rotate, so the plunger member cannot cause the rear rotor to rotate.

In other words, the lock device is configured such that the plunger member and the sleeve member integrally rotate even when an irregular key that has been inserted into the plunger member is rotated, but the rear rotor and the lock lever cannot be caused to rotate, and the lock mechanism is not unlocked.

That is, in the lock device described in JP-A No. 8-4387, when the regular key is inserted into the key hole and the plunger member is caused to rotate, the lock mechanism can be unlocked, but when the irregular key is inserted into the key hole and the irregular key is forcibly rotated, the plunger member and the sleeve member rotate together, so the lock mechanism is not unlocked. Moreover, because the plunger member and the sleeve member rotate together, unreasonable force does not act on the tumbler members that engage the plunger member and the sleeve member, so the lock device is structured such that damage to the tumbler members and the like is prevented.

However, when the lock device is to be unlocked, a plate-shaped key must be inserted into the key hole in the lock device and rotated counter to the rotational resistance of the plunger member, the rear rotor and the lock lever and the actuated resistance of the lock mechanism.

For this reason, in regard to the key used in this lock device, the material thereof is limited to a high-strength material such as iron or stainless steel, and it is necessary to make the thickness of the key sufficiently thick in accordance with the size of the transfer torque.

Further, in this lock device, plural plate-shaped tumbler members arranged in the plunger member are disposed at predetermined intervals in the axial direction and so as to be movable in an axis-orthogonal direction. When a key is inserted into the key hole, the concavo-tongue portions of the key and the key insertion hole in the plunger member contact each other. In the case of the regular key, all of the tumbler members move to regular positions and just the plunger member rotates, but in the case of the irregular key, at least one of the tumbler members moves to an irregular position, the plunger member and the sleeve member integrally rotate, and the rear rotor cannot be caused to rotate.

On the other hand, it is necessary to increase the number of the tumbler members in order to diversify the types of keys, and there is also the problem that the axial direction length of the plunger member must be made longer when the number of the tumbler members disposed at predetermined intervals in the plunger member is increased.

SUMMARY OF THE INVENTION

In consideration of the above-described circumstances, the present invention provides a lock device that can make the mechanical strength required of the key small and control the length of the plunger member from becoming longer even when the number of the tumbler members is increased.

A first aspect of the invention is a lock device including: a case member that is attached to a lock target; a sleeve member that is housed inside the case member such that the sleeve member is movable along an axial direction; a plunger member that is housed inside the sleeve member such that the plunger member is movable along the axial direction; tumbler members that are arranged at predetermined intervals in the axial direction inside the plunger member and disposed such that the tumbler members are movable in a direction orthogonal to the axial direction; recessed portions that are disposed in an inner wall of the sleeve member; tongue portions that are formed on the tumbler members, engage with the recessed portions, and cause the sleeve member and the plunger member to move integrally in the axial direction; energizing members that energize the tumbler members in a direction where the tongue portions engage with the recessed portions; key insertion holes that are formed in the tumbler members, engage with concavo-tongue portions formed on a regular key inserted into the plunger member, cause the tumbler members to move in a direction where the state of engagement between the tongue portions and the recessed portions is released, and also allow insertion of an irregular key; a contact wall that is disposed in the plunger member, is pushed against by a distal end portion of either the regular key or the irregular key inserted into the plunger member, and causes the plunger member to move in the axial direction; and a manipulable member that is rotatably coupled to the sleeve member and the plunger member, rotates when just the plunger member moves, and releases the locked state of the lock target, wherein engagement positions where the tongue portions disposed on the tumbler members that are adjacent and the recessed portions engage with each other are arranged such that the engagement positions are offset in a thickness direction of the keys.

According to this configuration, when the irregular key is inserted into the plunger, the state of engagement between the tongue portions formed on the tumbler members and the recessed portions formed in the sleeve member is maintained, and the sleeve member and the plunger member move integrally in the axial direction inside the case member even when the distal end portion of the irregular key pushes the contact wall of the plunger member. For this reason, the manipulable member maintains the locked state of the lock target.

On the other hand, when the regular key is inserted into the plunger member, the key insertion holes disposed in the tumbler members engage with the concavo-tongue portions formed on the regular key. Thus, the tumbler members move in a direction where the state of engagement between the tongue portions and the recessed portions is released counter to the energizing force of the energizing members that energize the tumbler members such that the tongue portions engage with the recessed portions.

Moreover, when the distal end portion of the regular key pushes the contact wall of the plunger member, just the plunger member moves inside the sleeve member. In this manner, just the plunger member moves, whereby the manipulable member releases the locked state of the lock target.

Consequently, the locked state of the lock target can be released simply by a user inserting the regular key into the plunger member and pushing this regular key. For this reason, it is not necessary to load a force in the rotational direction on the key and the mechanical strength along the turning direction required of the key can be made small in comparison to a rotary lock device where manipulation of the lock mechanism is performed by rotating the key after inserting the key into the plunger.

On the other hand, when the user tries to remove the regular key from the plunger member after releasing the locked state of the lock target, the state of engagement between the concavo-tongue portions formed on the regular key and the key insertion holes disposed in the tumbler members is maintained, and the plunger member moves and returns to its original position integrally with the removal of the regular key.

At this time, in order for the tongue portions of the tumbler members to engage with recessed portions other than the recessed portions with which the tumbler members had been initially engaged and not obstruct the movement of the plunger member, the attachment pitch of the tumbler members must be made longer than the moving distance (stroke) of the plunger member. In other words, the length of the plunger member ends up becoming longer when the number of the tumbler members is increased in order to diversify the types of keys.

However, in the present invention, the engagement positions where the tongue portions and the recessed portions engage with each other are arranged such that the engagement positions are offset in a thickness direction of the keys. For this reason, while the plunger member is being pushed, even when the regular key is removed from the plunger member and the tumbler members are returned to their initial positions by the energizing force of the energizing members, the tongue portions do not engage with recessed portions other than the recessed portions with which the tongue portions had initially been engaged. In other words, the length of the plunger member can be controlled from becoming longer even when the number of the tumbler members is increased.

In the lock device of the above-described aspect of the present invention, there may be three of the engagement positions in the thickness direction of the keys.

According to this configuration, there are three of the engagement positions in the thickness direction of the keys, so by creating three tumbler members whose tongue portions are offset, the length of the plunger member can be controlled from becoming longer even when the number of the tumbler members is increased.

In the lock device of the above-described aspect of the present invention, the engagement positions may be arranged in a staggered manner in the thickness direction of the keys.

According to this configuration, the engagement positions are arranged in a staggered manner in the thickness direction of the keys, so the tumbler members can be inverted and used, and the number of types of the tumbler members can be reduced.

According to the lock device of the present invention, the lock device makes the mechanical strength required of the key small and controls the length of the plunger member from becoming longer even when the number of the tumbler members is increased.

DETAILED DESCRIPTION OF THE INVENTION

A lock device 10 pertaining to a first embodiment of the present invention will be described in accordance with FIG. 1A and FIG. 1B to FIG. 8.

Figure 1B:
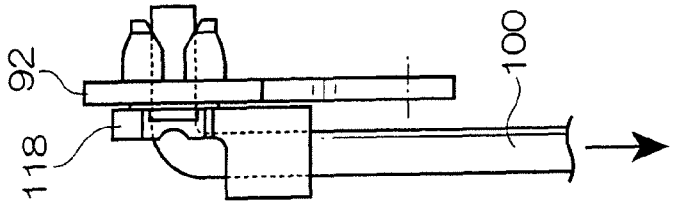
FIG. 1B is a rear view showing the lock device pertaining to the first embodiment of the invention and shows a coupling rod and an actuating lever as seen from the rear.
Figure 1A:
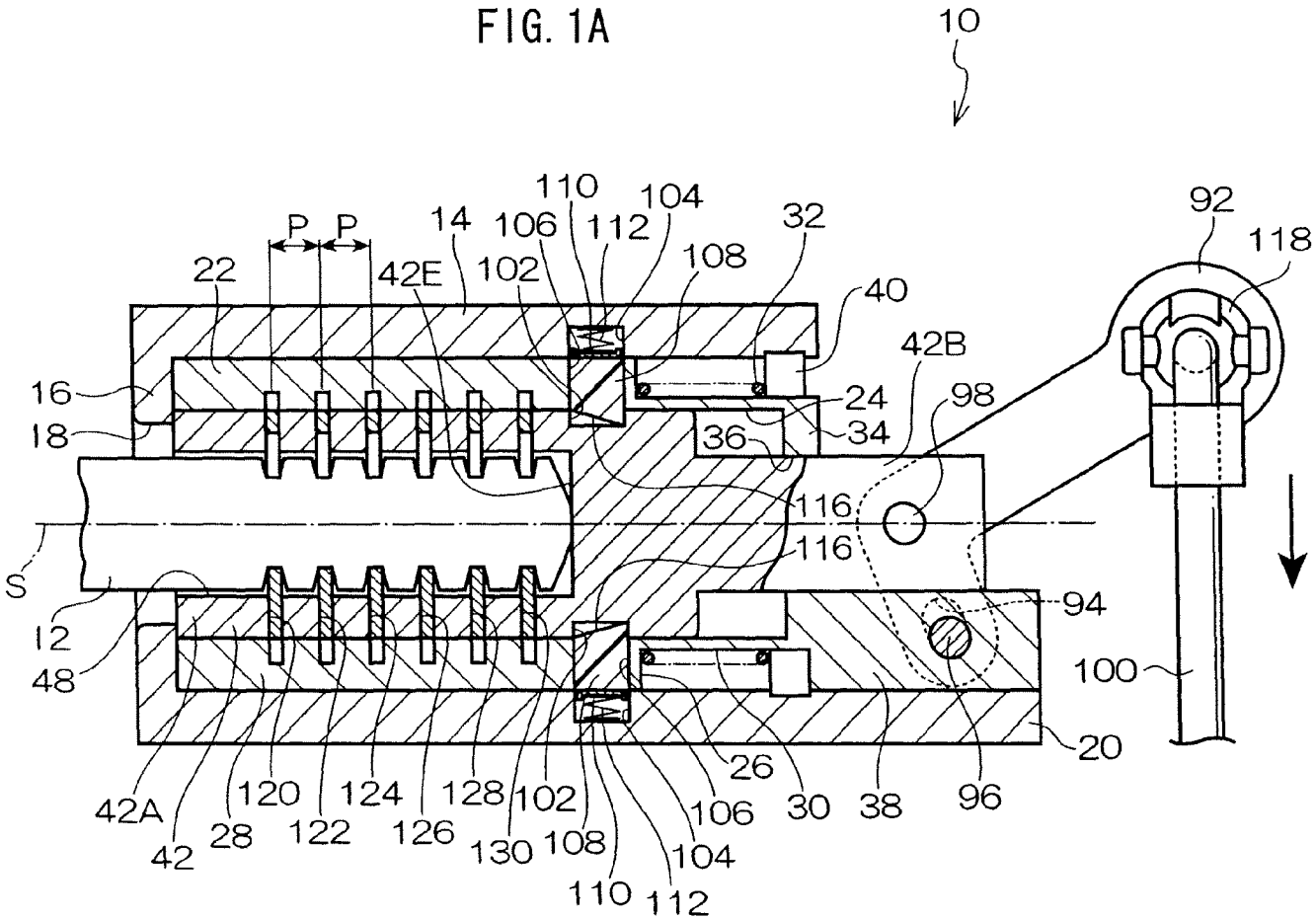
FIG. 1A is a side sectional view showing the configuration of a lock device pertaining to a first embodiment of the invention.

The lock device 10 of the present invention shown in FIG. 1A is disposed as part of a lock mechanism for locking and unlocking an open/close member, such as a door in an automobile, a trunk lid, or the lid of a glove box (lock target), and is used for a user to manipulate the lock mechanism (not shown) from a locked state to an unlocked state by a key 12.

Figure 4B:
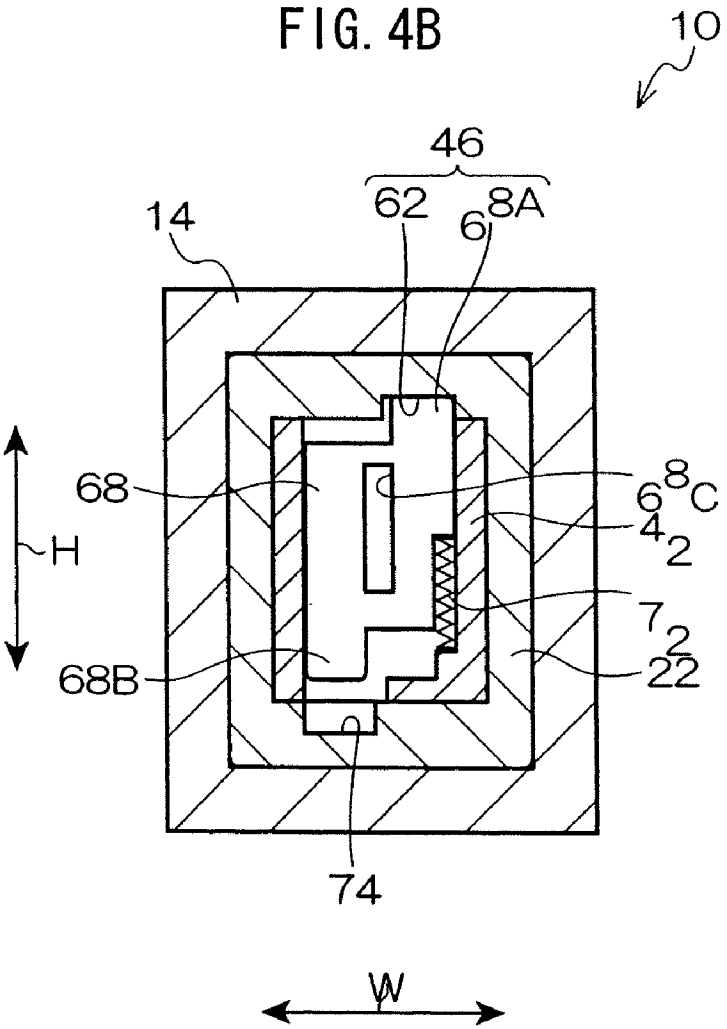
FIG. 4A and FIG. 4B are sectional views showing the configuration of the lock device pertaining to the first embodiment of the invention and show a state where the lock device is cut on a plane of tumbler plates.
Figure 4A:
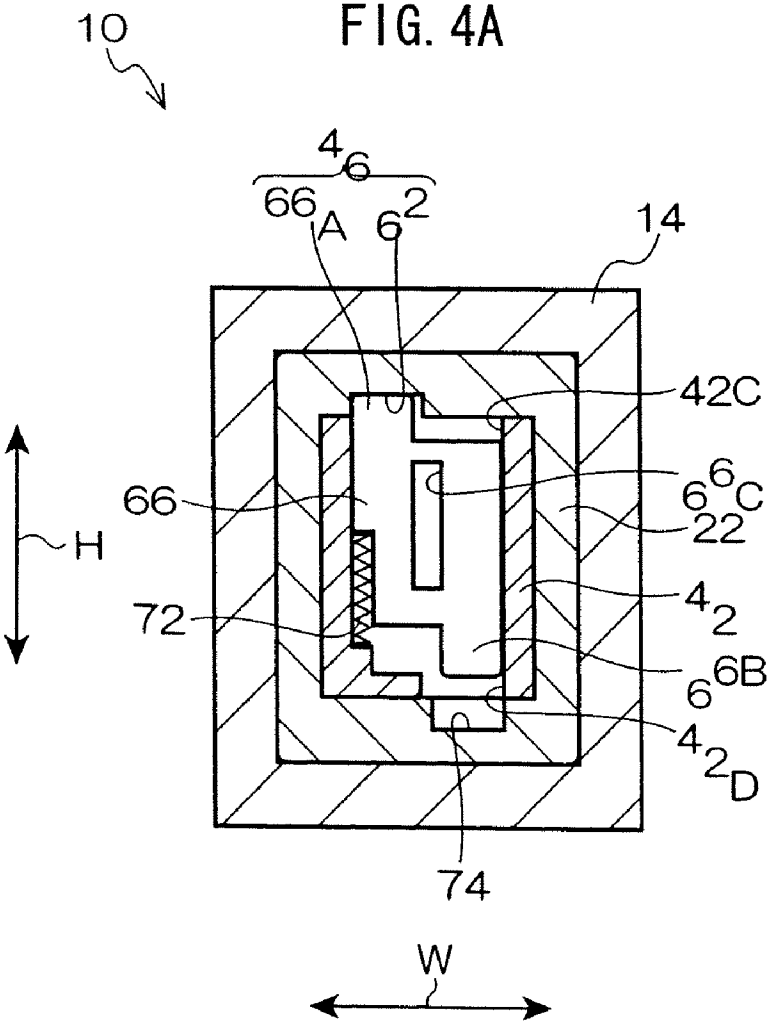

A square cylinder-shaped case member 14 is disposed in the lock device 10 as an outer shell portion of the device. The case member 14 is formed so as to be long and narrow in an axial direction (direction of line S in the drawings) and, as shown in FIG. 4A and FIG. 4B, has a substantially rectangular shape whose cross-sectional shape along a direction orthogonal to the axial direction of its peripheral wall portion (axis-orthogonal direction) is long in a height direction (direction of arrow H). Further, a lid portion 16 is formed in the case member 14 shown in FIG. 1A so as to close an opening on a distal end side (left side in FIG. 1A) of the case member 14 along the axial direction. A rectangular open portion 18, into whose center portion the key 12 is insertable, is formed in the lid portion 16. Moreover, a plate-shaped lever guide 20 that extends along the axial direction is integrally formed on the case member 14 on the lower end side of the rear end portion thereof.

The case member 14 of the lock device 10 is disposed inside a door or the like in which the lock mechanism is housed, and the case member 14 is fixed such that the open portion 18 faces the outside from the inside of the door or the like.

Moreover, the lock device 10 is disposed with a square cylinder-shaped sleeve member 22 that is disposed inside the case member 14. The sleeve member 22 is formed so as to be long and narrow in the axial direction and has a substantially rectangular shape whose cross-sectional shape along the axis-orthogonal direction of its peripheral wall portion is long in the height direction. The sleeve member 22 is inserted into the inside of the case member 14 and is supported by the case member 14 so as to be movable between a standby position shown in FIG. 1A and an actuated position shown in FIG. 3.

Further, the sleeve member 22 is configured such that its distal end surface contacts the inside of the lid portion 16 in a state where the sleeve member is in the standby position shown in FIG. 1A and such that the sleeve member 22 reaches the actuated position when the sleeve member 22 slides rearward a predetermined actuation stroke D (see FIG. 3) from the standby position.

Moreover, a plunger storage chamber 24 that is a space penetrating the sleeve member 22 in the axial direction is formed inside the sleeve member 22. Further, in the axial direction intermediate portion of an outer peripheral surface of the sleeve member 22, a step portion 26 is formed, a sleeve body 28 is formed on a distal end side via the step portion 26, and a spring holding portion 30 is formed on a rear end side.

The dimension of the spring holding portion 30 along the height direction (direction of arrow H in FIG. 4A and FIG. 4B) and a width direction (direction of arrow W in FIG. 4A and FIG. 4B) is smaller than that of the sleeve body 28, and a coil spring 32 including a winding portion bent in a substantially rectangular shape is disposed on the outer peripheral side of the spring holding portion 30.

Further, a lid portion 34 is formed on the sleeve member 22 so as to close an opening on a rear end side of the lid portion 34. A rod guide hole 36 that penetrates the lid portion 34 in the axial direction is formed in the center portion of the lid portion 34. Moreover, a slide lever 38 that extends from the lower end portion of the lid portion 34 towards the rear end side along the axial direction is integrally formed on the sleeve member 22. The lower end surface of the slide lever 38 is allowed to slidably contact the upper end surface of the lever guide 20 in the case member 14.

The outer peripheral surface of a cross-sectionally rectangular receiving member 40 that holds the rear end of the coil spring 32 is attached to the rear end portion of the case member 14, and the inner peripheral surface of the receiving member 40 slidably contacts the outer peripheral surface of the spring holding portion 30. Because of this configuration, the coil spring 32 is compressed and disposed between the step portion 26 of the sleeve member 22 and the receiving member 40, and the coil spring 32 always energizes the sleeve member 22 into the standby position.

Further, the lock device 10 is disposed with a plunger member 42 that is disposed inside the plunger storage chamber 24 of the sleeve member 22. The plunger member 42 is formed in a substantially square column shape (see FIG. 6) that is long and narrow in the axial direction, and the plunger member 42 is disposed with a plunger body 42A that is inserted into the inside of the plunger storage chamber 24 on the distal end side and a plunger rod 42B that projects in the axial direction from the rear end surface of the plunger body 42A.

Figure 3:
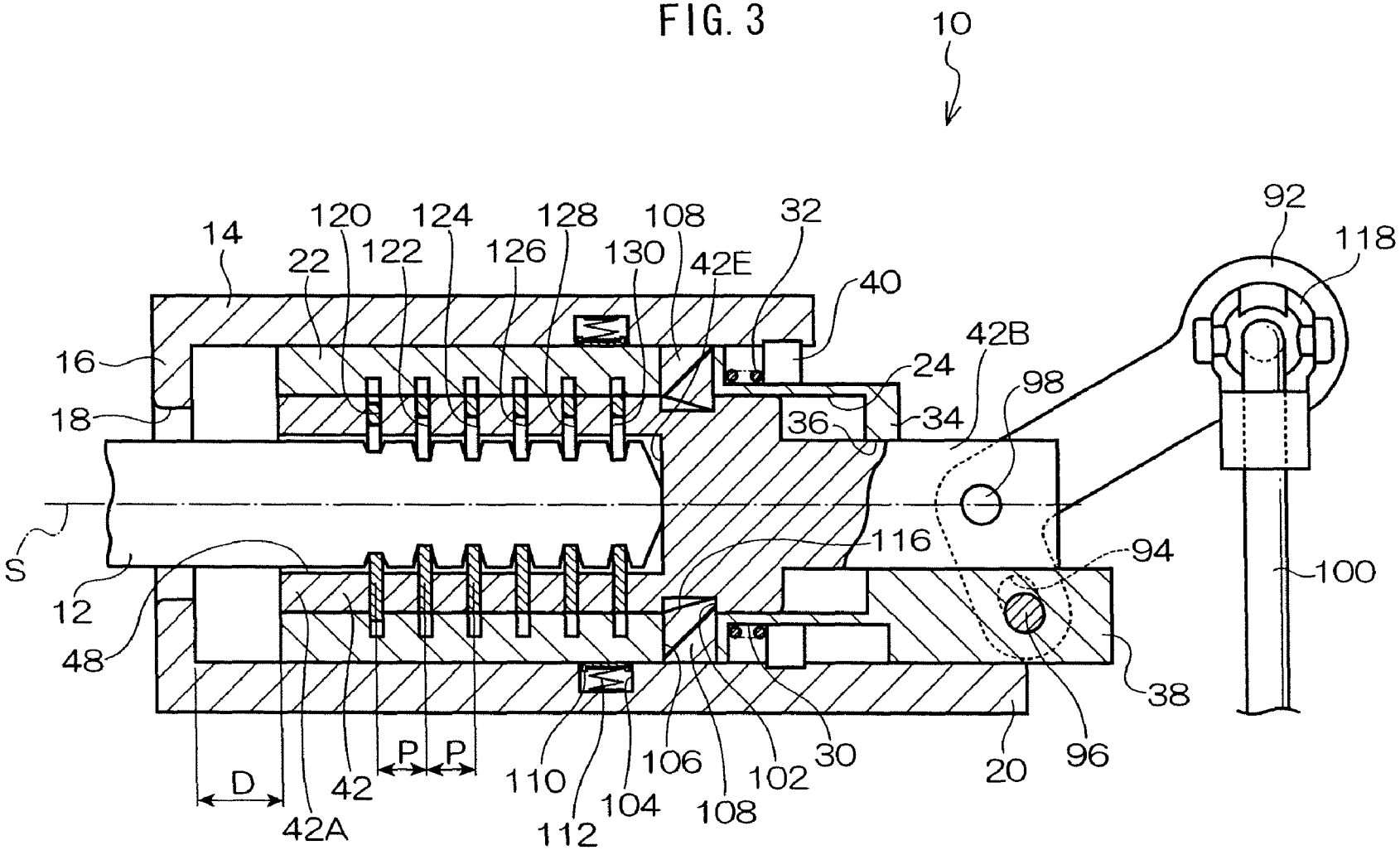
FIG. 3 is a side sectional view showing the configuration of the lock device pertaining to the first embodiment of the invention and shows a state where the plunger member and a sleeve member have moved to an actuated position.

The plunger body 42A is slidably inserted into the inside of the plunger storage chamber 24 and is supported by the case member 14 via the sleeve member 22 so as to be movable between a predetermined standby position (see FIG. 1A) and an actuated position (see FIG. 3).

The distal end surface of the plunger member 42 contacts the inside of the lid portion 16 in a state where the plunger member 42 is in the standby position, and the plunger member 42 reaches the actuated position when the plunger member 42 slides rearward the predetermined actuation stroke D (see FIG. 2 and FIG. 3) from the standby position. The details of the stroke D will be described later.

Moreover, the rear end side of the plunger rod 42B of the plunger member 42 projects to the outside of the sleeve member 22 through the rod guide hole 36 in the sleeve member 22. Further, the lower end surface of the plunger rob 42B projecting from the rod guide hole 36 slidably contacts, in the axial direction, the upper end surface of the slide lever 38.

Moreover, a key hole 48 disposed along the axial direction is formed in the central portion of the plunger body 42A, and the cross-sectional shape of the key hole 48 has a rectangular shape that is long and narrow along the height direction of the lock device 10. The cross-sectional shape of the key hole 48 corresponds to the shape of the key 12 that corresponds to the specifications of the lock device 10 pertaining to the present embodiment, and the key 12 is configured to be insertable into and removable from the key hole 48.

Figure 8:
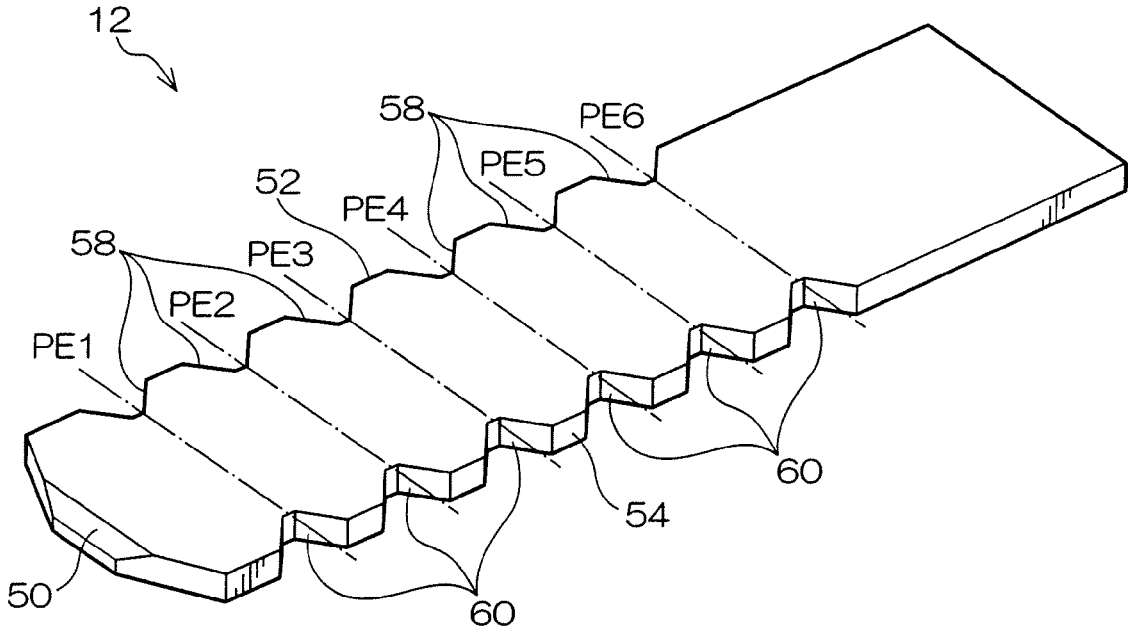
FIG. 8 is a perspective view showing a key of the lock device pertaining to the first embodiment of the invention.

As shown in FIG. 8, the portion of the key 12 that is inserted into the key hole 48 is formed in a long and narrow plate shape and is manufactured using a material such as metal, resin, paper, or a composite material of these, for example. Further, an insertion guide portion 50 whose thickness becomes thinner in a sloping manner from its proximal end side towards its distal end side is formed on the distal end portion of the key 12.

Moreover, one end surface and the other end surface of the key 12 along a direction orthogonal to the longitudinal direction thereof are configured as an upper engaging end 52 and a lower engaging end 54. The key 12 is inserted by a user into the key hole 48 with an orientation where the upper engaging end 52 faces up along the height direction of the device.

Further, six engagement positions PE1 to PE6 that are mutually different along the longitudinal direction of the key 12 (axial direction of the device) are disposed on the upper engaging end 52 and the lower engaging end 54 of the key 12, and upper engaged portion 58 and lower engaged portions 60 that are selectively recessed in "V" shapes are disposed in the engagement positions PE1 to PE6.

Further, as shown in FIG. 1A, plural (six in the present embodiment) tumbler storage chambers 120, 122, 124, 126, 128 and 130 are formed as slits in the plunger body 42A. The tumbler storage chambers 120, 122, 124, 126, 128 and 130 are arrayed at a substantially equal pitch along the axial direction, and this pitch is substantially equal to the pitch of the six engagement positions PE1 to PE6 of the key 12 (see FIG. 4A and FIG. 4B).

Moreover, an upper end open portion 42C and a lower end open portion 42D (see FIG. 4A and FIG. 4B) are disposed in the upper end portion and the lower end portion of each of the tumbler storage chambers 120, 122, 124, 126, 128 and 130, and tumbler plates 66 and 68 that are substantially tabular members are disposed inside the tumbler storage chambers 120, 122, 124, 126, 128 and 130. Here, an attachment pitch P of the tumbler plates 66 and 68 is set to be larger than half of the stroke D of the aforementioned plunger member 42 from the standby position to the actuated position. The details of the relationship between the attachment pitch and the stroke D will be described later.

Further, as shown in FIG. 4A, the tumbler plates 66 are disposed so as to be movable along the height direction inside the tumbler storage chambers 122, 126 and 130 that are disposed in the even number places from the distal end portion. Engaging tongue portions 66A that protrude from one side (the left side shown in FIG. 4A) of the upper surface of the plunger member 42 and engage with engaging recessed portions 62 disposed in the sleeve member 22 are disposed on the upper end portions of the tumbler plates 66.

Moreover, projecting portions 66B that project from the other side (the right side shown in FIG. 4A) of the lower surface of the plunger member 42 and engage with meshing recessed portions 74 disposed in the sleeve member 22 when the tumbler plates 66 move downward are disposed on the lower end portions of the tumbler plates 66. Further, rectangular key insertion holes 66C that extend up and down are disposed in the center portions of the tumbler plates 66, and the key insertion holes 66C are communicated with the key hole 48 (see FIG. 1A).

As shown in FIG. 4B, the tumbler plates 68 are disposed so as to be movable along the height direction inside the tumbler storage chambers 120, 124 and 128 that are disposed in the odd number places from the distal end portion. Engaging tongue portions 68A that protrude from one side (the right side shown in FIG. 4B) of the upper surface of the plunger member 42 and engage with the engaging recessed portions 62 disposed in the sleeve member 22 are disposed on the upper end portions of the tumbler plates 68. Projecting portions 68B that project from the other side (the left side shown in FIG. 4A) of the lower surface of the plunger member 42 and engage with the meshing recessed portions 74 disposed in the sleeve member 22 when the tumbler plates 68 move downward are disposed on the lower end portions of the tumbler plates 68. Further, rectangular key insertion holes 68C that extend up and down are disposed in the center portions of the tumbler plates 68, and the key insertion holes 66C are communicated with the key hole 48 (see FIG. 1A).

Moreover, coil springs 72 that energize the tumbler plates 66 and 68 upward are disposed in the tumbler storage chambers 120, 122, 124, 126, 128 and 130, and in a state where the key 12 (see FIG. 1A) is not inserted into the key hole 48 (see FIG. 1A), the engaging tongue portions 66A and 68A disposed on the upper ends of the tumbler plates 66 and 68 are energized by the coil springs 72 and engage with the engaging recessed portions 62 of the sleeve member 22.

Figure 6:
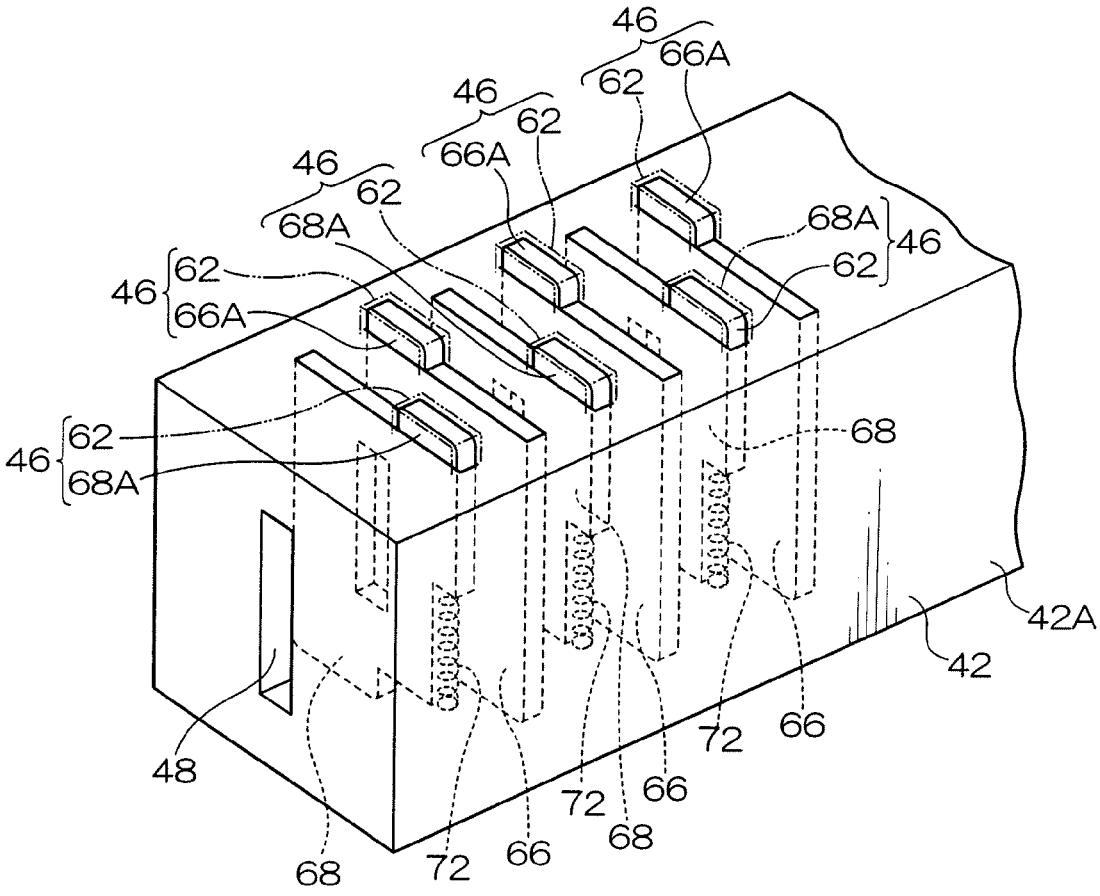
FIG. 6 is a perspective view showing the plunger member and the tumbler plates of the lock device pertaining to the first embodiment of the invention.
Figure 7:
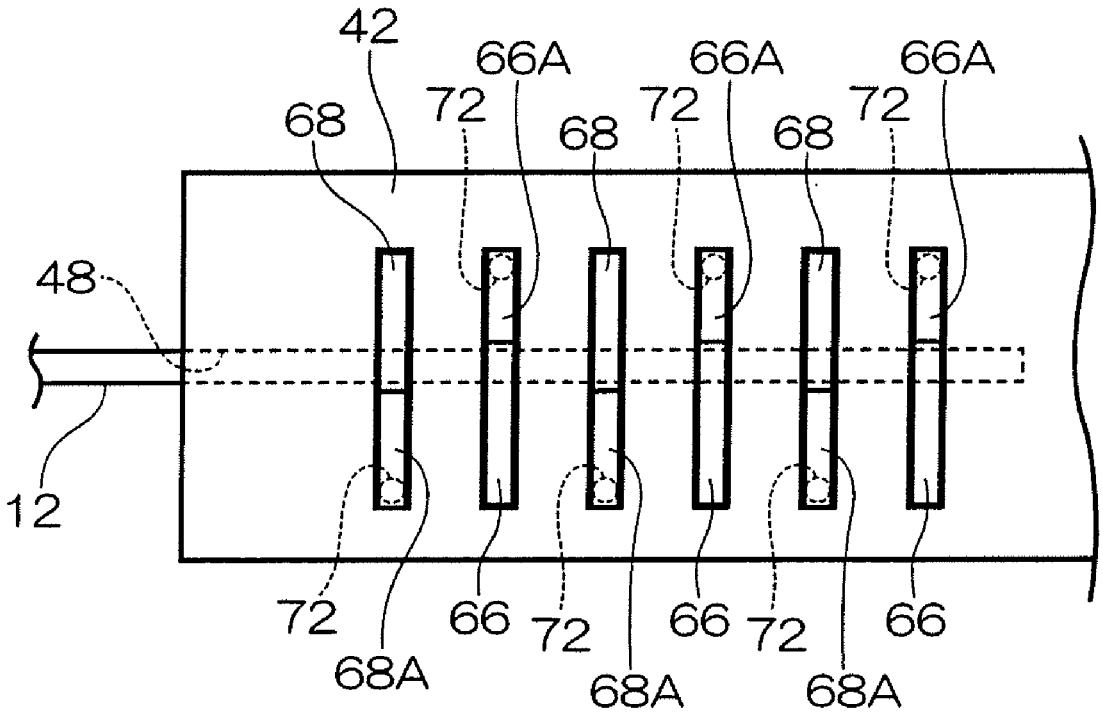
FIG. 7 is a plan view showing the plunger member and the tumbler plates of the lock device pertaining to the first embodiment of the invention.

In this state, as shown in FIG. 6 and FIG. 7, the engaging tongue portions 66A and the engaging tongue portions 68A are arranged in a staggered manner as a result of being offset in the thickness direction of the key. In other words, engagement positions 46 between the engaging tongue portions 66A and 68A and the engaging recessed portions 62 shown in FIG. 4A and FIG. 4B are also arranged in a staggered manner in the thickness direction of the key. It will be noted that in FIG. 6, the sleeve member 22 and the like are omitted in order to make it easier to understand the arranged state of the engaging tongue portions 66A and 68A.

As shown in FIG. 1A, the lock device 10 is configured such that, when the key 12 is inserted into the key hole 48 in the plunger member 42 in the standby position, the key 12 passes through the key insertion holes 66C and 68C in the tumbler plates 66 and 68, the upper edge portions or the lower edge portions of the key insertion holes 66C and 68C in the tumbler plates 66 and 68 engage with the upper engaged portions 58 or the lower engaged portions 60 (see FIG. 8) of the key 12, and the tumbler plates 66 and 68 move in the height direction counter to the energizing force of the coil springs 72.

Consequently, the lock device 10 is configured such that, when the key 12 is inserted into the key hole 48, the six tumbler plates 66 and 68 move along the height direction (sliding direction) to positions corresponding to the upper engaged portions 58 and the lower engaged portions 60 of the key 12. Here, a key code for unlocking the lock device 10 is imparted beforehand to the lock device 10, and the shapes (depths) of the upper engaged portions 58 and the lower engaged portions 60 that become the engagement partners of the tumbler plates 66 and 68 are set in accordance with the key code.

As long as the key 12 is suited to the specifications of the lock device 10 pertaining to the present embodiment, the key 12 is insertable into and removable from the key hole 48, but as the key 12, there is one where the shapes of all of its upper engaged portions 58 and its lower engaged portions 60 that become the engagement partners of the tumbler plates 66 and 68 correspond to the key code (this will be called a "regular key 12R" below) and one whose shape does not correspond to the key code and does not match that of the regular key 12R (this will be called an "irregular key 12I" below).

When the regular key 12R is inserted into the key hole 48, the six tumbler plates 66 and 68 move to regular positions corresponding to the upper engaged portions 58 and the lower engaged portions 60 such that the state of engagement between the engaging tongue portions 66A and 68A and the engaging recessed portions 62 is released.

Figure 5A:
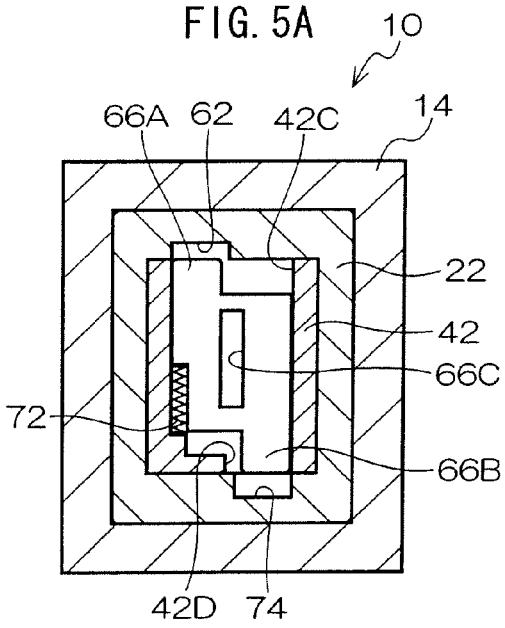
FIG. 5A, FIG. 5B, FIG. 5C and FIG. 5D are sectional views showing the configuration of the lock device pertaining to the first embodiment of the invention and show a state where the lock device is cut on the plane of the tumbler plate and the tumbler plates have moved.
Figure 5B:
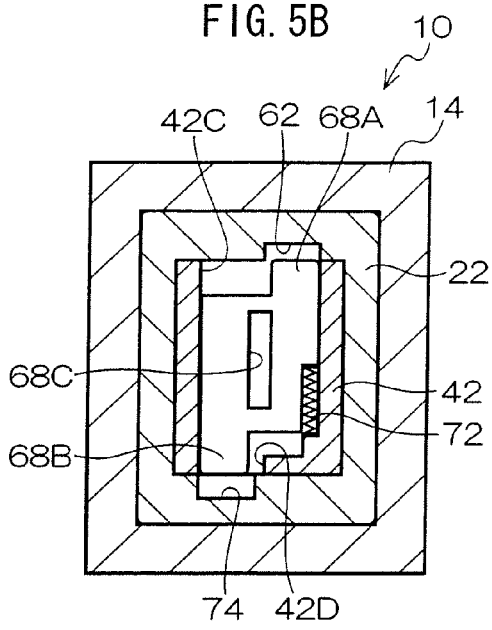
Figure 5C:
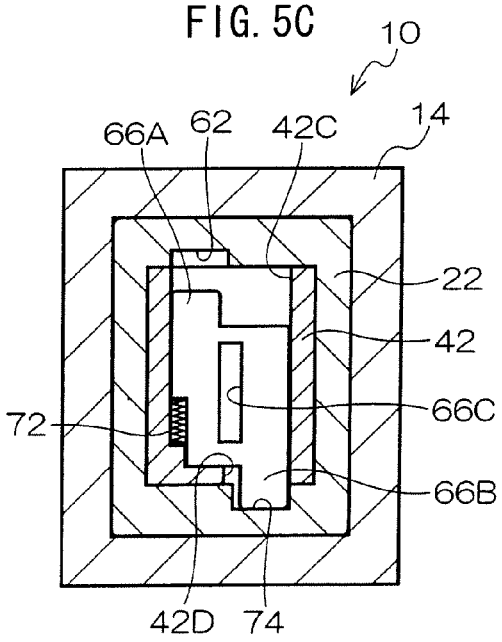
Figure 5D:
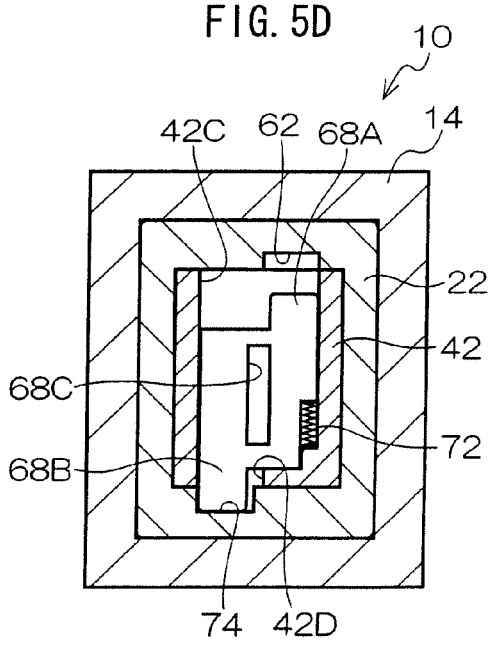

In other words, all of the tumbler plates 66 and 68 move downward such that the engaging tongue portions 66A and 68A move away from the engaging recessed portions 62, and the tumbler plates 66 and 68 move to the regular positions shown in FIG. 5A and FIG. 5B. At this time, moreover, as shown in FIG. 5C and FIG. 5D, the tumbler plates 66 and 68 do not move too far downward and the projecting portions 66B and 68B of the tumbler plates 66 and 68 do not engage with the meshing recessed portions 74.

Figure 2:
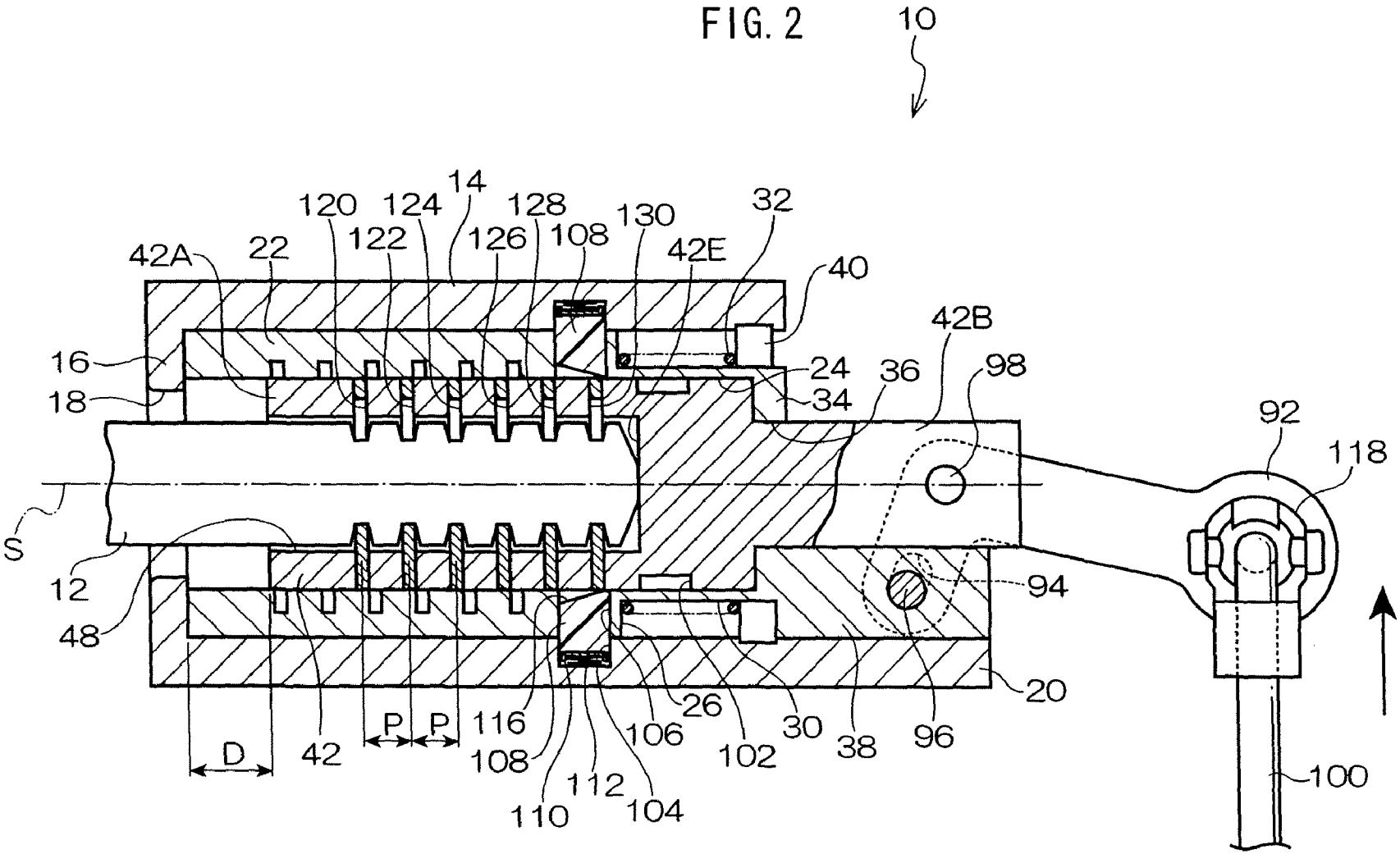
FIG. 2 is a side sectional view showing the configuration of the lock device pertaining to the first embodiment of the invention and shows a state where just a plunger member has moved to an actuated position.

In this manner, when all of the tumbler plates 66 and 68 move to the regular positions, the engagement between the sleeve member 22 and the plunger member 42 is released, and when the normal key 12R is pushed further in the axial direction, the distal end portion of the normal key 12R pushes a contact wall 42E formed in the bottom of the plunger member, the sleeve member 22 is restrained in the standby position by a later-described locking bar 108 as shown in FIG. 2, and just the plunger member 42 slides inside the sleeve member 22 and moves to the actuated position.

Further, the lock device 10 is configured such that, when the irregular key 12I is inserted into the key hole 48 shown in FIG. 1A, the tumbler plates 66 and 68 moves to positions corresponding to the upper engaged portions 58 and the lower engaged portions 60 (see FIG. 8) of the key 12, and at least one of the tumbler plates 66 and 68 moves to an irregular position, so the state of engagement between the engaging tongue portions 66A and 68A and the engaging recessed portions 62 is maintained, or the projecting portions 66B and 68B and the meshing recessed portions 74 engage with each other.

In this manner, when at least one of the tumbler plates 66 and 68 moves to an irregular position, the state of engagement between the sleeve member 22 and the plunger member 42 is not released, and when the irregular key 12I is further pushed in the axial direction, as shown in FIG. 3, the later-described locking bar 108 is held in a storage hole 106, and the plunger member 42 slides inside the case member 14 counter to the energizing force of the coil spring 32 together with the sleeve member 22 and moves to the actuated position.

As shown in FIG. 1A, a plate-shaped actuating lever 92 that is coupled to the rear end portion of the plunger rod 42B and coupled to the end portion of the slide lever 38 is disposed in the lock device 10, and the actuating lever 92 is bent in a substantial "L" shape.

A slot-like coupling hole 94 that is long in the longitudinal direction is formed in a proximal end portion (in FIG. 1A, the lower end portion) of the actuating lever 92. Further, a circular column-shaped coupling shaft 96 whose axial direction is in the width direction of the device is disposed in the slide lever 38, and the coupling shaft 96 is inserted into the coupling hole 94 in the actuating lever 92 and configured to be movable along the longitudinal direction of the coupling hole 94. Thus, the actuating lever 92 is swingably coupled to the slide lever 38.

Further, a circular column-shaped pushing shaft 98 whose axial direction is in the width direction is disposed in the rear end portion of the plunger rod 42B. The pushing shaft 98 penetrates a corner portion of the L-shaped actuating lever 92 and is rotatably coupled to the actuating lever 92.

Moreover, the distal end of the actuating lever 92 is disposed so as to extend rearward from the pushing shaft 98, and a circular cylinder-shaped bearing member 118 is attached to the distal end portion of the actuating lever 92. Further, an upper end portion of a long and narrow round bar-shaped coupling rod 100, which upper end portion is bent in an "L" shape, is rotatably coupled to the bearing member 118. Moreover, the coupling rod 100 is disposed so as to extend along the height direction, and the lower end portion of the coupling rod 100 is coupled to the lock mechanism (not shown).

Because of this configuration, the actuating lever 92 is disposed so as to be swingable between a predetermined locked position (see FIG. 1A) and an unlocked position (see FIG. 2) about the coupling shaft 96 of the slide lever 38.

It will be noted that the positions of the coupling shaft 96 and the pushing shaft 98 are set such that, as shown in FIG. 1A, in a state where the sleeve member 22 and the plunger member 42 are in the standby positions, the actuating lever 92 is held in the locked position, and as shown in FIG. 2, in a state where the sleeve member 22 is in the standby position and just the plunger member 42 has moved the stroke D from the standby position to the actuated position, the actuating lever 92 swings to the unlocked position.

In this manner, when the actuating lever 92 swings from the locked position to the unlocked position, it causes the coupling rod 100 to move downward and transmit pushing force (manipulating force) to the lock mechanism via the coupling rod 100. When the lock mechanism receives this operating force, it changes from a locked state to an unlocked state to enable an open/close member such as a door, a trunk lid, or the lid of a glove box that had been locked by the lock mechanism to be opened.

As shown in FIG. 3, when the sleeve member 22 and the plunger member 42 integrally move from the standby positions to the actuated positions, the relative positional relationship between the pushing shaft 98 and the coupling shaft 96 does not change, so the actuating lever 92 is held in the locked position. Consequently, the lock device is maintained in the locked state and is not unlocked. In this state, when the user stops pushing the key 12 (in this case, a key whose shape is different from that of the regular key 12R), the sleeve member 22 and the plunger member 42 in the actuated positions are returned to the standby positions by the energizing force of the coil spring 32.

Further, as shown in FIG. 1A, a recessed inner peripheral locking hole 102 is formed in the upper end portion and the lower end portion of the outer peripheral surface of the plunger body 42A, and a recessed outer peripheral locking hole 104 is formed in the upper end portion and the lower end portion of the inner peripheral surface of the case member 14. The inner peripheral locking hole 102 is disposed on the rear end side of the tumbler plates 66, and the outer peripheral locking hole 104 is disposed so as to be in the same position as the inner peripheral locking hole 102 along the axial direction and the width direction of the device when the plunger member 42 is in the standby position.

Moreover, the storage hole 106 is formed in the sleeve member 22 so as to penetrate the sleeve member 22 along the axis-orthogonal direction. The storage hole 106 is disposed so as to be in the same position as the outer peripheral locking hole 104 and the inner peripheral locking hole 102 along the axial direction and the width direction in a state where the sleeve member 22 and the plunger member 42 are in the standby positions. Further, the cross-sectional shapes along the axial direction of the outer peripheral locking hole 104, the inner peripheral locking hole 102 and the storage hole 106 match each other.

Moreover, the substantially square column-shaped locking bar 108 is stored, so as to be slidable along the axis-orthogonal direction, inside the storage hole 106, and an energizing plate 110 and a spring 112 are inserted into the outer peripheral locking hole 104. The outer peripheral side of the locking bar 108 is configured as a flat surface whose end surface is parallel to the axial direction, and the distal end surface of the locking bar 108 is configured as a flat cam surface 116 that slants towards the outer peripheral side from the rear end along the axial direction towards the distal end.

Moreover, the locking bar 108 is configured such that its rear end portion is insertable into and removable from the outer peripheral locking hole 104 in state where its rear end surface is caused to pressingly contact the plate-shaped energizing plate 110 when the sleeve member 22 is in the standby position. Further, when the sleeve member 22 and the plunger member 42 are in the same position along the axial direction, the distal end portion of the locking bar 108 is removably inserted into the inner peripheral locking hole 102 and caused to pressingly contact the bottom surface portion of the inner peripheral locking hole 102. The energizing plate 110 is slidably inserted into the outer peripheral locking hole 104, and the spring 112 is disposed in a compressed state between the energizing plate 110 and the bottom surface portion of the outer peripheral locking hole 104.

When the regular key 12R is inserted into the key hole 48 and the plunger member 42 starts moving from the standby position to the actuated position, the cam surface 116 of the locking bar 108 receives a partial force (pushing force) along the axis-orthogonal direction from the outer peripheral surface of the plunger member 42, whereby the locking bar 108 is pushed out towards the outer peripheral side counter to the energizing force of the spring 112. Thus, as shown in FIG. 2, the rear end portion of the locking bar 108 is inserted into the outer peripheral locking hole 104. At this time, the locking bar 108 is disposed so as to straddle the boundary between the outer peripheral locking hole 104 and the storage hole 106, so the locking bar 108 restrains the sleeve member 22 in the standby position. Further, when the plunger member 42 that has moved to the actuated position returns to the standby position, as shown in FIG. 1, the locking bar 108 is moved towards the inner peripheral side by the energizing force of the spring 112 such that the distal end portion of the locking bar 108 is inserted into the inner peripheral locking hole 102.

Further, in a state where the irregular key 12I whose shape is different from that of the regular key 12R is inserted into the key hole 48 and the plunger member 42 is coupled to the sleeve member 22 by the tumbler plates 66 and 68, as shown in FIG. 3, the locking bar 108 moves in the axial direction integrally with the sleeve member 22 and the plunger member 42 while being held in the storage hole 106 and the inner peripheral locking hole 102.

Next, the action of the lock device 10 according to this configuration will be described.

When the user inserts the irregular key 12I whose shape is different from that of the regular key 12R into the key hole 48 shown in FIG. 1A, the tumbler plates 66 and 68 move to positions corresponding to the upper engaged portions 58 and the lower engaged portions 60 of the irregular key 12I, and the state of engagement between the engaging tongue portions 66A and 68A of at least one of the tumbler plates 66 and 68 and the engaging recessed portions 62 is maintained (see FIG. 4A and FIG. 4B), or the projecting portions 66B and 68B become engaged with the meshing recessed portions 74 and the state of engagement between the sleeve member 22 and the plunger member 74 is maintained.

Moreover, when the user pushes the irregular key 12I in the axial direction, as shown in FIG. 3, the plunger member 42 and the sleeve member 22 integrally move the stroke D from the standby positions to the actuated positions.

The actuating lever 92 in the locked position does not swing even when the plunger member 42 and the sleeve member 22 integrally reach the actuated positions, so the locked state of the lock mechanism is maintained. Thereafter, when the user stops pushing the irregular key 12I, the plunger member 42 and the sleeve member 22 are integrally returned to the standby positions by the energizing force of the coil spring 32.

On the other hand, when the user inserts the regular key 12R into the key hole 48 shown in FIG. 1A, the tumbler plates 66 and 68 move to the regular positions (see FIG. 5A and FIG. 5B) corresponding to the upper engaged portions 58 and the lower engaged portions 60 of the regular key 12R, and the state of engagement between the sleeve member 22 and the plunger member 42 is released.

Moreover, when the user pushes the regular key 12R in the axial direction, as shown in FIG. 2, just the plunger member 42 moves the stroke D from the standby position to the actuated position in a state where the sleeve member 22 is restrained in the standby position by the locking bar 108 whose cam surface 116 has been pushed out.

When just the plunger member 42 reaches the actuated position, the actuating lever 92 swings to the unlocked position, pushes the coupling rod 100 down, and unlocks the lock mechanism that had been locked. Thus, the open/close member that had been locked by the lock mechanism is unlocked and becomes capable of being opened.

Thereafter, when the uses removes the regular key 12R from the plunger member 42, the state of engagement between the upper engaged portions 58 and the lower engaged portions 60 formed on the regular key 12R and the key insertion holes 66C and 68C disposed in the tumbler plates 66 and 68 is maintained, and the plunger member 42 returns to the standby position integrally with the removal of the regular key 12R.

Here, as mentioned before, the attachment pitch P of the tumbler plates 66 and 68 is set to be larger than half of the stroke D. Moreover, as shown in FIG. 4A, FIG. 4B and FIG. 6, the engagement positions 46 are arranged in a staggered manner in the thickness direction of the key.

For this reason, even when the user removes the regular key 12R from the key hole 48 in the actuated position of the plunger member 42 shown in FIG. 2 and the tumbler plates 66 and 68 are energized upward by the energizing force of the coil springs 72 (see FIG. 4A and FIG. 4B), the engaging tongue portions 66A and 68A do not engage with other engaging recessed portions 62 other than the engaging recessed portions 62 with which they engage when disposed in the standby position. In other words, they do not obstruct the return of the plunger member 42 to the standby position.

That is, because the attachment pitch P of the tumbler plates 66 and 68 is set to be larger than half of the stroke D, the tumbler plates 66 and 68 are configured to stop before they reach the engaging recessed portions 62 disposed on the same axial line even when the plunger 42 is moved to the actuated position.

When the engagement positions 46 are not offset in the thickness direction of the key, the engaging tongue portions 66A and 68A engage with other engaging recessed portions 62 and obstruct the return of the plunger member 42 to the standby position, so the attachment pitch P of the tumbler plates 66 and 68 must be set to be larger than the stroke D. For that reason, the lock device 10 must be made long in the axial direction in order to ensure the predetermined stroke D.

However, by staggering the engagement positions 46 in the thickness direction of the key as in the present embodiment, it suffices for the attachment pitch P of the tumbler plates 66 and 68 to be set to be larger than half of the stroke D, so that even when the number of the tumbler plates 66 and 68 is increased in order to diversify the types of the key 12, the length of the plunger member 42 can be controlled from becoming longer.

Further, the user inserts the key 12 into the key hole 48 and pushes the key 12 along the axial direction of the device; thus, when the key 12 is the regular key 12R, the lock mechanism can be unlocked, and when the key 12 is the irregular key 12I, the lock mechanism can be maintained in a locked state. Therefore, it is not necessary for rotational torque to be transmitted by the key 12 during key manipulation by the user in comparison to a rotary lock device where manipulation with respect to a manipulated device is performed by rotating the key after inserting the key into the key insertion hole, and just a load along the axial direction acts on the key 12, so the mechanical strength along the turning direction required of the key 12 can be made sufficiently small.

Further, because the mechanical strength can be made small, it becomes unnecessary for the key 12 to invariably be manufactured by a high-strength material such as iron or stainless steel, and the key 12 can be manufactured by a low-strength material whose use as a conventional material had been difficult, such as plastic, paper to which a waterproof treatment has been administered, an aluminum alloy, or a magnesium alloy, for example. Further, even when the thickness of the key 12 is made significantly thinner in comparison to that of a conventional key, problems such as deformation do not arise.

Further, even when the irregular key 12I including a driver or the like is inserted into the key hole 48 and pushed to the actuated position, the lock mechanism does not become unlocked simply by the plunger member 42 and the sleeve member 22 integrally moving from the standby positions to the actuated positions. Moreover, unreasonable force does not act on the configural parts such as the case member 14, the sleeve member 22, the plunger member 42, and the tumbler plates 66 and 68 disposed in these, so damage to these configural parts can be effectively prevented.

Next, a second embodiment of the lock device 10 of the present invention will be described in accordance with FIG. 9A and FIG. 9B.

It will be noted that the same reference numerals will be given to members that are the same as those in the first embodiment, and that description of those same members will be omitted. As shown in FIG. 9A and FIG. 9B, in this embodiment, in contrast to the first embodiment, not only are the engaging tongue portions 66A and 68A disposed on the upper ends of the tumbler plates 66 and 68, but engaging tongue portions 80A and 82A are also disposed on the lower ends of tumbler plates 80 and 82.

Figure 9B:
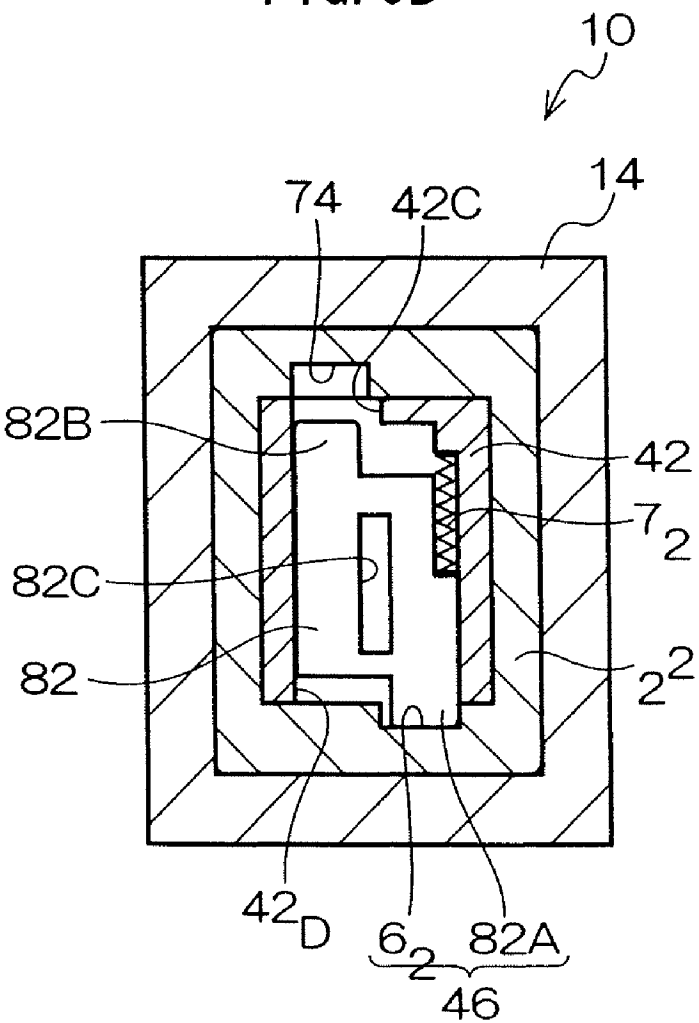
FIG. 9A and FIG. 9B are sectional views showing the configuration of a lock device pertaining to a second embodiment of the invention and show a state where the lock device is cut on a plane of tumbler plates.
Figure 9A:
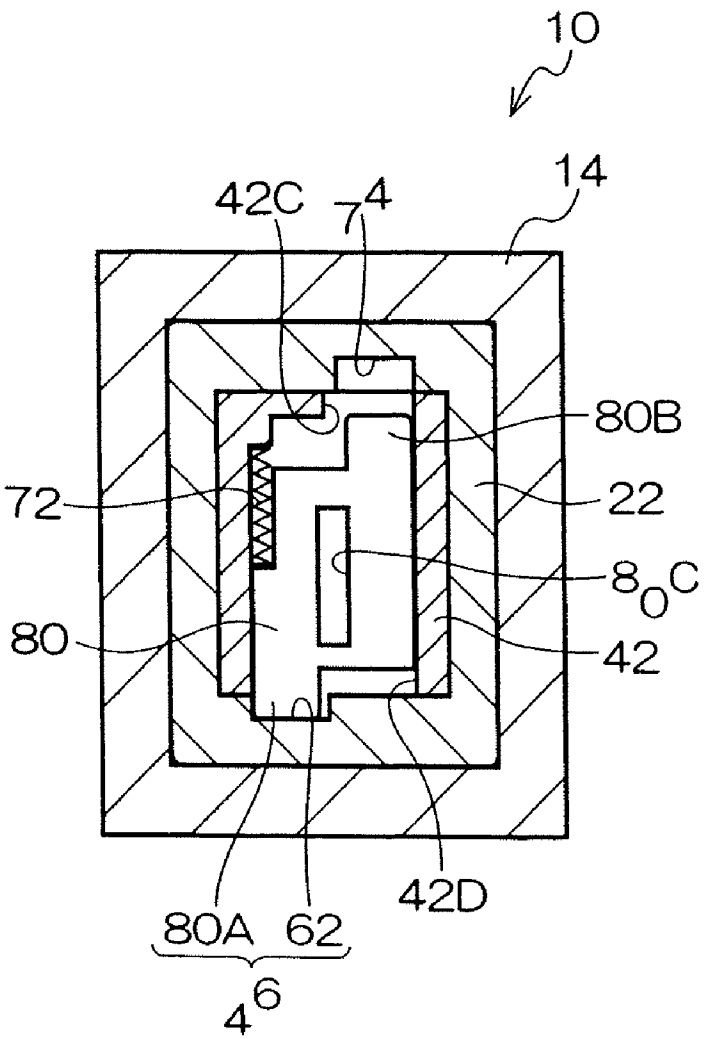

Specifically, the tumbler plates 66 disposed with the engaging tongue portions 66A on one side of their upper ends (see FIG. 4A) are disposed inside the tumbler storage chambers 120 and 128, the tumbler plates 68 disposed with the engaging tongue portions 68A on the other side of their upper ends (see FIG. 4B) are disposed inside the tumbler storage chambers 122 and 130, a tumbler plate 80 disposed with the engaging tongue portion 80A on one side of its lower end (see FIG. 9A) is disposed inside the tumbler storage chamber 124, and the tumbler plate 82 disposed with the engaging tongue portion 82A on the other side of its lower end is disposed inside the tumbler storage chamber 126 (see FIG. 9B).

In this manner, by disposing the engagement positions 46 configured by the engaging tongue portions 80A and 82A and the engaging recessed portions 62 also on the lower side of the plunger member 42, the number of key codes can be increased.

What is claimed is:

1. A lock device comprising:

a case member that is attached to a lock target;

a sleeve member that is housed inside the case member such that the sleeve member is movable relative to the case member along an axial direction;

a plunger member that is housed inside the sleeve member such that the plunger member is movable along the axial direction;

tumbler members that are arranged at predetermined intervals in the axial direction inside the plunger member and disposed such that the tumbler members are movable in a direction orthogonal to the axial direction;

recessed portions that are disposed in an inner wall of the sleeve member;

tongue portions that are formed on the tumbler members, engage with the recessed portions, and cause the sleeve member and the plunger member to move integrally in the axial direction;

energizing members that energize the tumbler members in a direction where the tongue portions engage with the recessed portions;

key insertion holes that are formed in the tumbler members, engage with concavo-tongue portions formed on a regular key inserted into the plunger member, cause the tumbler members to move in a direction where the state of engagement between the tongue portions and the recessed portions is released, and also allow insertion of an irregular key;

a contact wall that is disposed in the plunger member, is pushed against by a distal end portion of either the regular key or the irregular key inserted into the plunger member, and causes the plunger member to move in the axial direction; and a manipulable member that is rotatably coupled to the sleeve member and the plunger member, rotates when just the plunger member moves axially relative to the sleeve member, and releases the locked state of the lock target, wherein engagement positions where the tongue portions disposed on the tumbler members that are adjacent and the recessed portions engage with each other are arranged such that the engagement positions are offset in a thickness direction of the keys.

2. The lock device of claim 1, wherein the engagement positions are disposed in different three places in the thickness direction of the keys.

3. The lock device of claim 1, wherein the engagement positions are arranged in a staggered manner as a result of being offset in the thickness direction of the keys.

4. The lock device of claim 1, wherein the predetermined intervals of the tumbler members arranged inside the plunger member are equal to or greater than ½ of a movable distance of the plunger member resulting from insertion of the keys.

5. The lock device of claim 1, wherein just the plunger member moves axially relative to both the case member and the sleeve member, and releases the locked state of the lock target.

6. A lock device comprising:

a case member that is attached to a lock target;

a sleeve member that is housed inside the case member such that the sleeve member is movable relative to the case member along an axial direction;

a plunger member that is housed inside the sleeve member such that the plunger member is movable along the axial direction;

a coupling structure in which a key insertion hole that allows insertion of a key is formed, the coupling structure being placed inside the plunger member, coupling together the sleeve member and the plunger member, and configured to release the coupling just when a regular key is inserted into the key insertion hole; and a manipulable member that is rotatably coupled to the sleeve member and the plunger member, rotates when just the plunger member moves axially relative to the sleeve member, and releases the locked state of the lock target.

7. The lock device of claim 6, wherein the coupling structure includes plural tabular members that are arranged at predetermined intervals in the axial direction inside the plunger member and disposed such that the tabular members are movable in a direction orthogonal to the axial direction;

plural recessed portions that are disposed in an inner wall of the sleeve member;

tongue portions that are formed on the tabular members, engage with the recessed portions, and cause the sleeve member and the plunger member to move integrally in the axial direction;

energizing members that energize the tabular members in a direction where the tongue portions engage with the recessed portions;

key insertion holes that are formed in the tabular members, engage with concavo-tongue portions formed on a regular key inserted into the plunger member, and cause the tabular members to move in a direction where the state of engagement between the tongue portions and the recessed portions is released; and a contact wall that is disposed in the plunger member, contacts and is pushed against by a distal end portion of the regular key when the regular key is inserted into the plunger member, and causes the plunger member to move in the axial direction.

8. The lock device of claim 7, wherein the plural recessed portions disposed in the inner wall of the sleeve member are positioned at predetermined intervals in the axial direction, and the recessed portions that are adjacent are formed in different positions in a thickness direction of the regular key.

9. The lock device of claim 7, wherein the plural recessed portions disposed in the inner wall of the sleeve member are positioned at predetermined intervals in the axial direction, and every other of the recessed portions is formed in the same position in a thickness direction of the regular key.

10. The lock device of claim 7, wherein the predetermined intervals of the tabular members arranged inside the plunger member are equal to or greater than ½ of a movable distance of the plunger member resulting from insertion of the regular key.

11. The lock device of claim 6, wherein just the plunger member moves axially relative to both the case member and the sleeve member, and releases the locked state of the lock target.

* * * * *